US006819307B2

(12) United States Patent
Kang et al.

(10) Patent No.: US 6,819,307 B2
(45) Date of Patent: Nov. 16, 2004

(54) PLASMA DISPLAY PANEL AND DRIVING METHOD THEREOF

(75) Inventors: Seok Dong Kang, Kumi-shi (KR); Young Joon Ahn, Kumi-shi (KR)

(73) Assignee: LG Electronics Inc., Seoul (KR)

( * ) Notice: Subject to any disclaimer, the term of this patent is extended or adjusted under 35 U.S.C. 154(b) by 232 days.

(21) Appl. No.: 09/775,640

(22) Filed: Feb. 5, 2001

(65) Prior Publication Data

US 2001/0011974 A1 Aug. 9, 2001

(30) Foreign Application Priority Data

Feb. 3, 2000 (KR) ..... P00-05458
Mar. 17, 2000 (KR) ..... P00-13518

(51) Int. Cl.[7] ..... G09G 3/28
(52) U.S. Cl. ..... 345/60; 315/169.4
(58) Field of Search ..... 345/60–72; 315/169.4; 313/483, 484, 505; G09G 3/28

(56) References Cited

U.S. PATENT DOCUMENTS 5,877,734 A * 3/1999 Amemiya ..... 345/60
5,998,935 A * 12/1999 Marcotte ..... 315/169.4
6,031,329 A * 2/2000 Nagano ..... 313/582
6,037,916 A * 3/2000 Amemiya ..... 345/60
6,084,349 A * 7/2000 Ueoka et al. ..... 313/587
6,459,201 B1 * 10/2002 Schermerhorn et al. .... 313/586
6,479,932 B1 * 11/2002 Nunomura ..... 313/582
6,498,594 B1 * 12/2002 Nunomura ..... 345/60

FOREIGN PATENT DOCUMENTS

| | | | |
|---|---|---|---|
| JP | 04-082135 | * 3/1992 | ..... G09G/3/28 |
| JP | 10-333636 | 12/1998 | |
| JP | 11-238462 | 8/1999 | |
| KR | 1998-66123 | 8/1990 | |
| KR | 1998-54703 | 7/1998 | |

* cited by examiner

*Primary Examiner*—Alexander Eisen
(74) *Attorney, Agent, or Firm*—Fleshner & Kim, LLP

(57) ABSTRACT

A plasma display panel and a driving method thereof that are capable of improving the brightness and the discharge efficiency. In the plasma display panel, an auxiliary electrode pair causes an auxiliary discharge. An area of the auxiliary electrode at the periphery of a discharge cell is wider than that at the center of the discharge cell. A sustaining electrode pair is arranged at each side of the auxiliary electrode pair to cause a sustaining discharge by utilizing the auxiliary discharge. In the driving method, wall charges concentrate on the center portion of the discharge cell during an auxiliary discharge generated between the auxiliary electrode pair. Then, a sustaining discharge is generated between the sustaining electrode pair by utilizing the wall charges produced by the auxiliary discharge.

16 Claims, 8 Drawing Sheets

PLASMA DISPLAY PANEL AND DRIVING METHOD THEREOF

BACKGROUND OF THE INVENTION

1. Field of the Invention

This invention relates to a flat panel display device, and more particularly to a plasma display panel that is capable of improving the discharge efficiency and the brightness. Also, the present invention is directed to a method of driving said plasma display panel.

2. Description of the Related Art

Generally, a plasma display panel (PDP) radiates a fluorescent body by an ultraviolet with a wavelength of 147 nm generated during a discharge of He+Xe or Ne+Xe gas to thereby display a picture including characters and graphics. Such a PDP is easy to be made into a thin film and large-dimension type. Moreover, the PDP provides a very improved picture quality owing to a recent technical development. The PDP is largely classified into a direct current (DC) driving system and an alternating current (AC) driving system. The DC-type PDP causes an opposite discharge between an anode and a cathode provided at a front substrate and a rear substrate, respectively to display a picture. On the other hand, the AC-type PDP allows an alternating voltage signal to be applied between electrodes having dielectric layer therebetween to generate a discharge every half-period of the signal, thereby displaying a picture. Since such an AC-type PDP uses a dielectric material which allows a wall charge to be accumulated on the surface thereof upon discharge, it produces a memory effect.

Referring to FIG. 1, the AC-type PDP includes a front substrate 1 provided with a sustaining electrode pair 10, and a rear substrate 2 provided with an address electrode 4. The front substrate 1 and the rear substrate 2 are spaced in parallel to each other with having barrier ribs 3 therebetween. A mixture gas, such as Ne–Xe or He–Xe, etc., is injected into a discharge space defined by the front substrate 1, the rear substrate 2 and the barrier ribs 3. The sustaining electrode 10 makes a pair by two within a single of plasma discharge channel. Any one of the sustaining electrode pair 10 is used as a scanning/sustaining electrode that responds to a scanning pulse applied in an address interval to cause an opposite discharge along with the address electrode 4 while responding to a sustaining pulse applied in a sustaining interval to cause a surface discharge with the adjacent sustaining electrodes 10. Also, the remaining one of the sustaining electrode pair 10 is used as a common sustaining electrode to which a sustaining pulse is applied commonly. On the front substrate 1 provided with the sustaining electrodes 10, a dielectric layer 8 and a protective layer 9 are disposed. The dielectric layer 8 is responsible for limiting a plasma discharge current as well as accumulating a wall charge during the discharge. The protective film 9 prevents a damage of the dielectric layer 8 caused by the sputtering generated during the plasma discharge and improves the emission efficiency of secondary electrons. This protective film 9 is usually made from MgO. The barrier ribs 3 for dividing the discharge space are extended perpendicularly at the rear substrate 2. On the surfaces of the rear substrate 2 and the barrier ribs 3, a fluorescent material 5 excited by a vacuum ultraviolet lay to generate a visible light is provided.

In such an AC-type PDP, one frame consists of a number of sub-fields so as to realize gray levels by a combination of the sub-fields. For instance, when it is intended to realize 256 gray levels, one frame interval is time-divided into 8 sub-fields. Further, each of the 8 sub-fields is again divided into a reset interval, an address interval and a sustaining interval. The entire field is initialized in the reset interval. The discharge pixel cells on which a data is to be displayed are selected by the address discharge in the address interval. The selected discharge pixel cells sustain the discharge in the sustaining interval. The sustaining interval is lengthened by an interval corresponding to $2^n$ depending on a weighting value of each sub-field. In other words, the sustaining interval involved in each of first to eighth sub-fields increases at a ratio of $2^0$, $2^1$, $2^3$, $2^4$, $2^5$, $2^6$ and $2^7$. To this end, the number of sustaining pulses generated in the sustaining interval also increases into $2^0$, $2^1$, $2^3$, $2^4$, $2^5$, $2^6$ and $2^7$ depending on the sub-fields. The brightness and the chrominance of a displayed image are determined in accordance with a combination of the sub-fields. However, the three-electrode, AC surface-discharge PDP has problems in that, since a voltage required for the sustaining discharge is high, the power consumption is large and that the discharge and light-emission efficiency upon sustaining-discharge between the sustaining electrode pair is low.

In order to solve these problems of the three-electrode, AC surface-discharge PDP, there has been suggested a PDP provided with four sustaining electrodes.

Referring to FIG. 2 and FIG. 3, the conventional five-electrode PDP includes a sustaining electrode pair 13 and 16 and a trigger electrode pair 30 and 36 formed on a front substrate 20, and an address electrode 17 formed on a rear substrate 18. The trigger electrode pair 30 and 36 is provided between the sustaining electrode pair 13 and 16 to cause a trigger discharge by a wall voltage produced upon address-discharge and an application voltage, thereby initiating a sustaining electrode. The sustaining electrode pair 13 and 16 forms a pair within a single plasma discharge channel. Any one of the sustaining electrode pair 13 and 16 is used as a scanning/sustaining electrode that responds to a scanning pulse applied in an address interval to cause an opposite discharge along with the address electrode 17 while responding to a sustaining pulse applied in a sustaining interval to cause a surface discharge with the adjacent sustaining electrode 13 or 16. Also, the remaining one of the sustaining electrode pair 13 and 16 is used as a common sustaining electrode to which a sustaining pulse is applied commonly. The sustaining electrode pair 13 and 16 causes a sustaining discharge by a wall voltage formed by the trigger discharge generated between the trigger electrode pair 30 and 36 and an application voltage. The sustaining electrode pair 13 and 16 and the trigger electrode pair 30 and 36 have a line width smaller than transparent electrodes 28 and 34 and includes metal bus electrodes 26 and 32 formed at one edge of the transparent electrodes 28 and 34, respectively. A dielectric layer 23 and a protective layer 24 are disposed on the front substrate 20 to cover the sustaining electrode pair 13 and 16 and the trigger electrode pair 30 and 36. Wall charges produced upon plasma display are accumulated in the dielectric layer 23. The protective film 24 prevents a damage of the dielectric layer 23 caused by the sputtering generated during the plasma discharge and improves the emission efficiency of secondary electrons. Barrier ribs 25 and a fluorescent material 22 are formed on the rear substrate 18 provided with the address electrode 17.

When the sustaining electrode pair 13 and 16 of the five-electrode PDP is compared with the sustaining electrode pair 10 of the three-electrode PDP, a distance between the sustaining electrode pair 13 and 16 is longer than that between the electrode pair 10. Thus, the five-electrode PDP has a better light-emission efficiency than the three-electrode PDP upon discharge.

However, as shown in FIG. 4, the five-electrode PDP concentrates the sustaining discharge upon the middle portion of the discharge cell. The PDP having such a structure has a problem in that only a portion of energy produced upon sustaining-discharge excites the fluorescent material. In other words, only a portion of energy produced during the sustaining discharge excites the fluorescent material while the remaining energy other than the energy exciting the fluorescent material emerges an excessive current flowing the electrodes. As a result, the PDP has a large power consumption and a low discharge and light-emission efficiency.

SUMMARY OF THE INVENTION

Accordingly, it is an object of the present invention to provide a plasma display panel and a driving method thereof that are capable of improving the discharge efficiency as well as the brightness.

In order to achieve these and other objects of the invention, a plasma display panel according to one aspect of the present invention includes an auxiliary electrode pair for causing an auxiliary discharge in which its area at the periphery of a discharge cell is wider than that at the center of the discharge cell; and a sustaining electrode pair arranged at each side of the auxiliary electrode pair to cause a sustaining discharge by utilizing the auxiliary discharge.

A plasma display panel according to another aspect of the present invention includes a transparent electrode formed at the sustaining electrode pair in such a manner to be separated within the discharge cell.

A method of driving a plasma display panel according to still another aspect of the present invention includes the steps of enlarging an area of an auxiliary electrode pair corresponding to the center portion of a discharge cell to concentrate wall charges on the center portion of the discharge cell during an auxiliary discharge generated between the auxiliary electrode pair; and causing a sustaining discharge between a sustaining electrode pair by utilizing the wall charges produced by the auxiliary discharge.

A method of driving a plasma display panel according to still another aspect of the present invention includes the steps of causing an auxiliary discharge between a trigger electrode pair; and simultaneously causing a plurality of sustaining discharge within a discharge cell using an auxiliary electrode pair.

BRIEF DESCRIPTION OF THE DRAWINGS

These and other objects of the invention will be apparent from the following detailed description of the embodiments of the present invention with reference to the accompanying drawings, in which.

DETAILED DESCRIPTION OF THE PREFERRED EMBODIMENT

Figure 1:
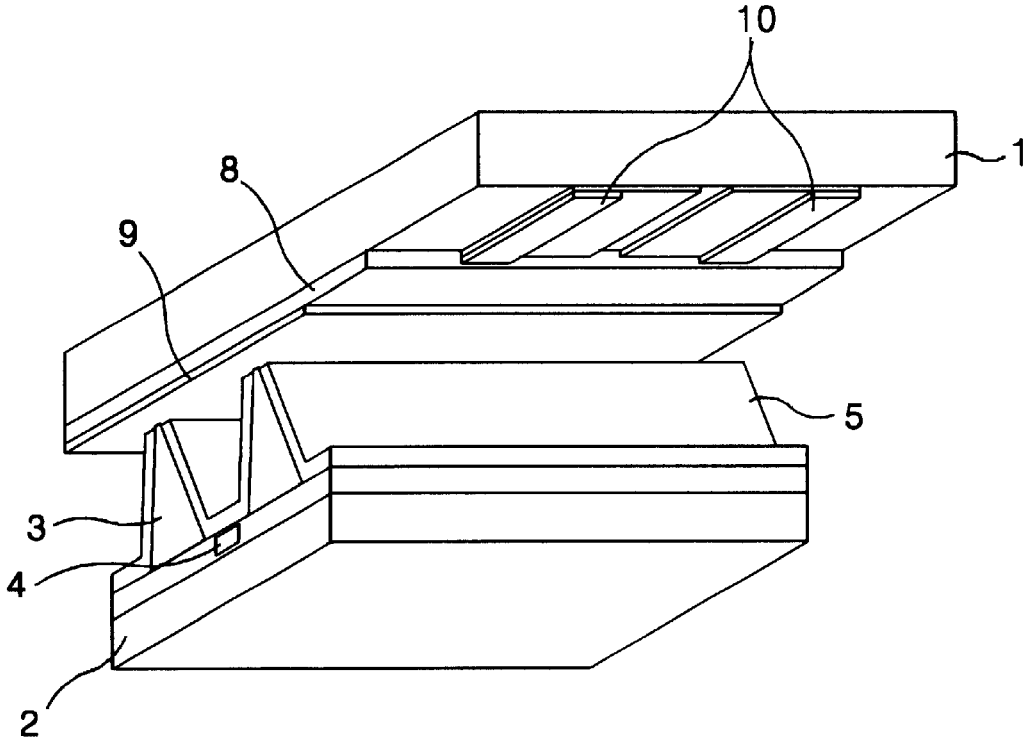
FIG. 1 CONVENTIONAL ART
FIG. 1 is a schematic perspective view showing the structure of a conventional three-electrode plasma display panel.
Figure 2:
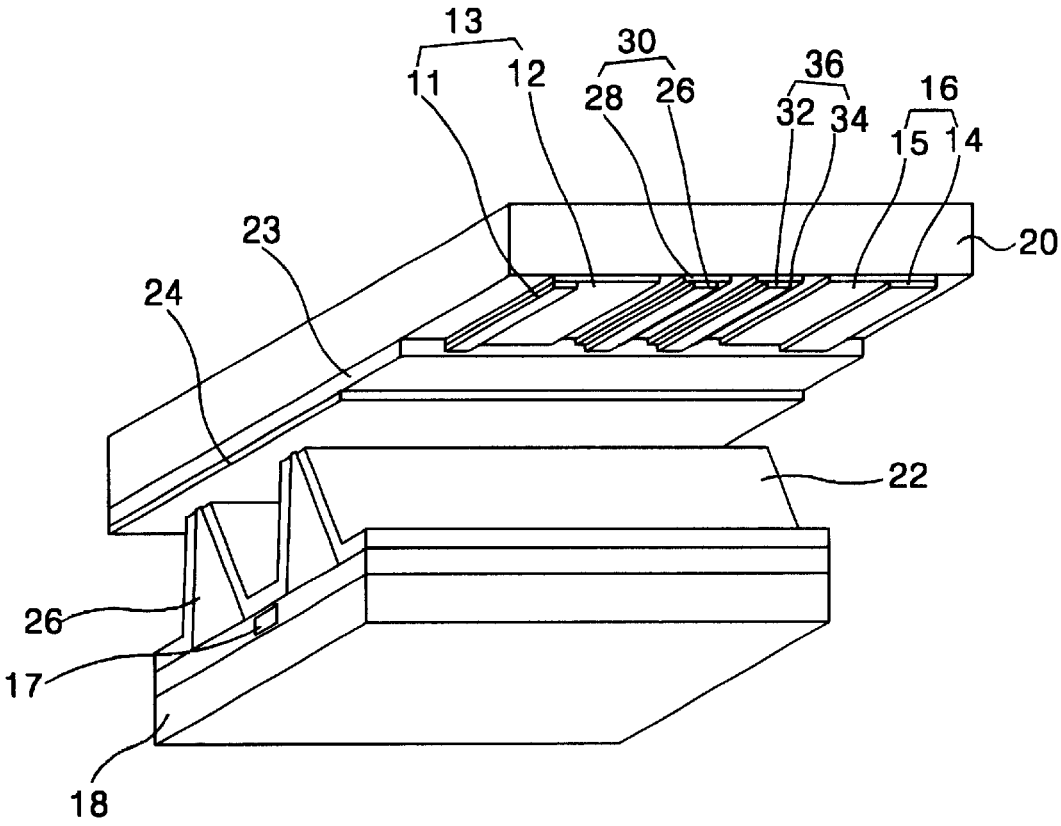
FIG.2 CONVENTIONAL ART
FIG. 2 is a schematic perspective view showing the structure of a conventional five-electrode plasma display panel.
Figure 3:
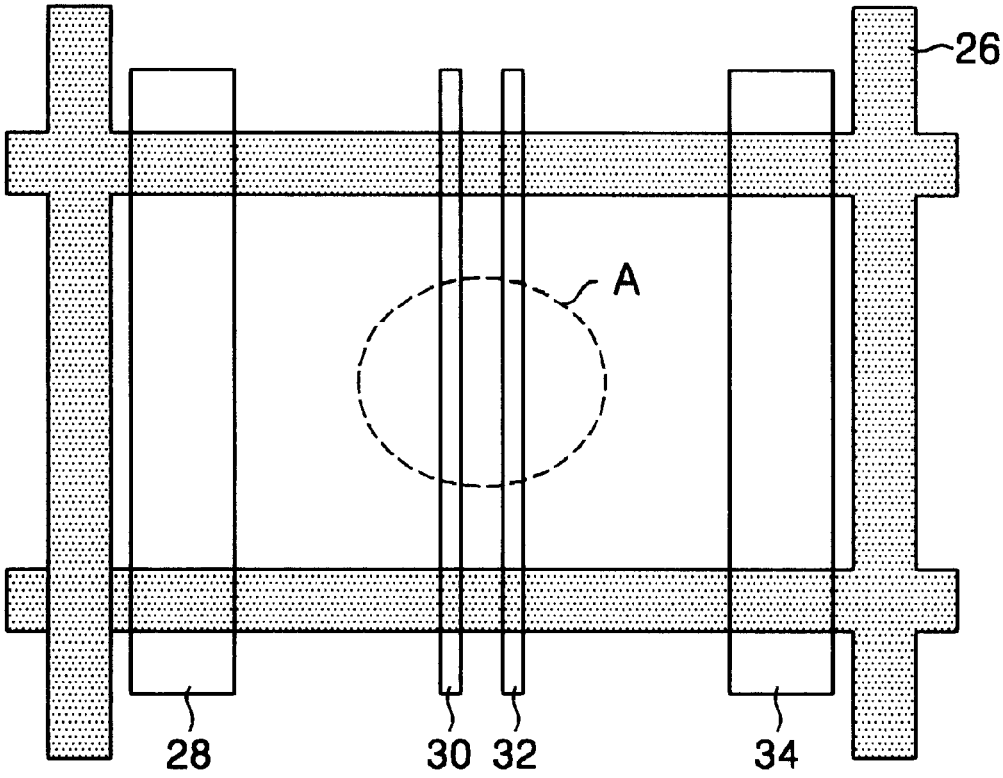
FIG.3 CONVENTIONAL ART
FIG. 3 and FIG. 4 are plan views showing a discharge cell structure of the conventional five-electrode plasma display panel.
Figure 4:
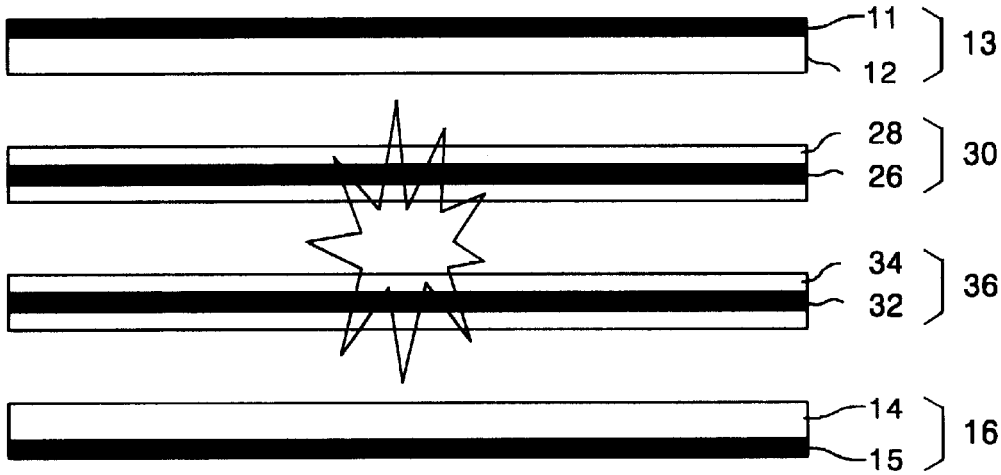
FIG. 4 CONVENTIONAL ART
Figure 5:
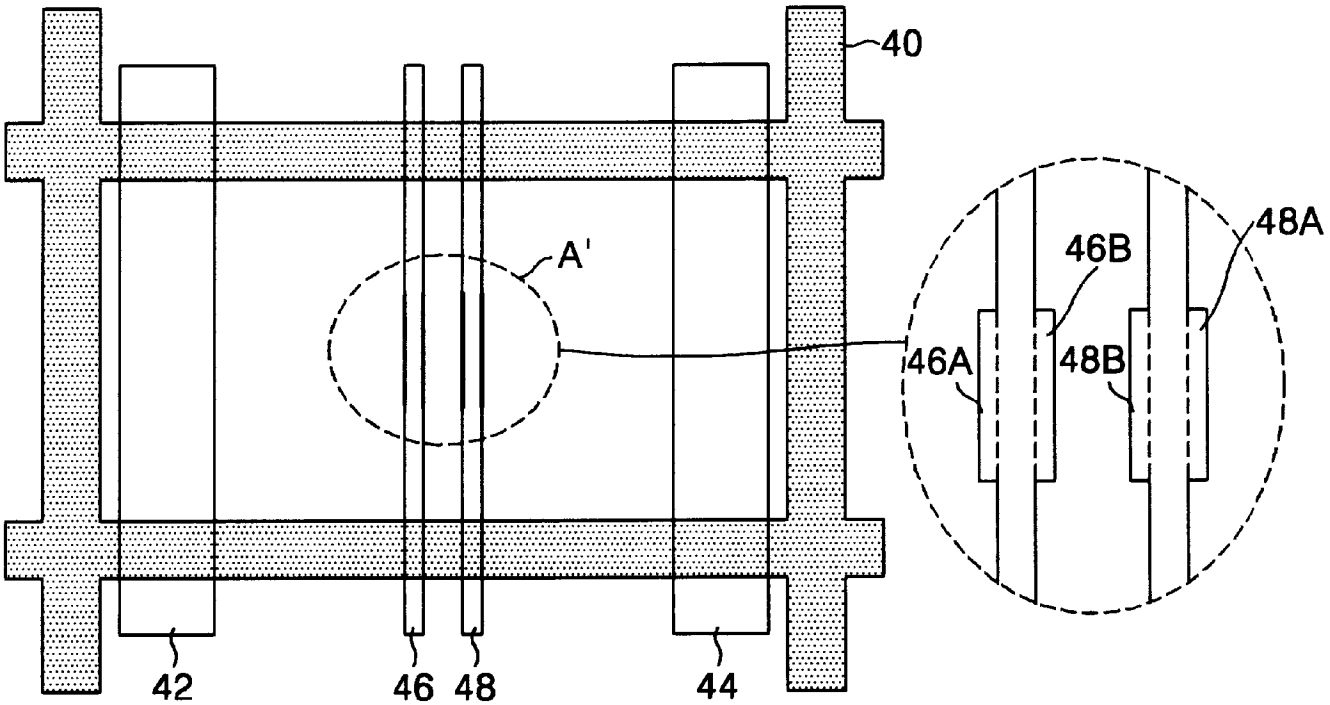
FIG. 5 is a plan view showing a discharge cell structure of a plasma display panel according to a first embodiment of the present invention.

Referring to FIG. 5, there is shown a five-electrode plasma display panel (PDP) according to a first embodiment of the present invention. The five-electrode PDP includes a sustaining electrode pair 42 and 44 and a trigger electrode pair 46 and 48 formed on a front substrate (not shown). The sustaining electrode pair 42 and 44 forms a pair within a single plasma discharge channel. Any one of the sustaining electrode pair 42 and 44 is used as a scanning/sustaining electrode that responds to a scanning pulse applied in an address interval to cause an opposite discharge along with an address electrode (not shown) while responding to a sustaining pulse applied in a sustaining interval to cause a surface discharge with the adjacent sustaining electrode 42 or 44. Also, the remaining one of the sustaining electrode pair 42 and 44 is used as a common sustaining electrode to which a sustaining pulse is applied commonly. The trigger electrode pair 46 and 48 has wings 46A, 46B and 48A, 48A formed symmetrically at each side of the center portion A'. The trigger electrode pair 46 and 48 are provided between the sustaining electrode pair 42 and 44 to cause a trigger discharge by a wall voltage produced by the address discharge and an application voltage, thereby initiating a sustaining discharge. The trigger electrode pair 46 and 48 receives an AC trigger pulse voltage in the sustaining interval to cause an auxiliary discharge. Just after the auxiliary discharge is generated, a sustaining pulse is applied to the sustaining electrode 42. Then, the sustaining electrode pair 42 and 44 can generate a discharge by a priming effect caused by the auxiliary discharge, wall charges accumulated in the discharge cell and a voltage difference caused by the sustaining pulse. Such a sustaining discharge is continuously generated by the sustaining pulse and the trigger pulse.

Accordingly, in the PDP according to the first embodiment, the wings are formed at the center portions of the trigger electrodes such that the center portions of the trigger electrodes have a wide electrode area. Thus, since the wall charges are concentrated in the area around the wings of the trigger electrodes when the auxiliary discharge has been generated within the discharge cell, a voltage applied to the discharge cell becomes high even though a low voltage is applied to the trigger electrodes from the exterior. Therefore, the sustaining discharge can be maintained by an application of a low trigger voltage.

Figure 6:
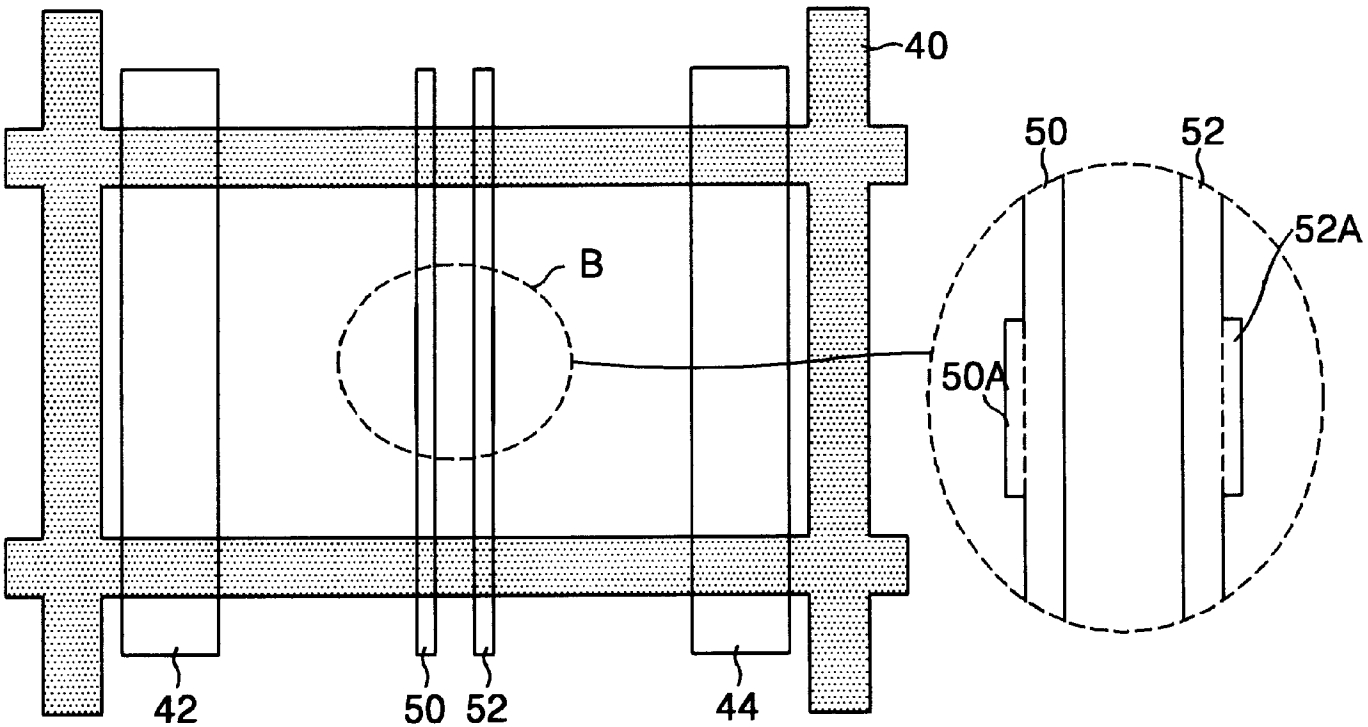
FIG. 6 is a plan view showing a discharge cell structure of a plasma display panel according to a second embodiment of the present invention.

Referring to FIG. 6, there is shown a five-electrode PDP according to a second embodiment of the present invention. The five-electrode PDP includes a sustaining electrode pair 42 and 44 and a trigger electrode pair 50 and 52 formed on a front substrate (not shown). The sustaining electrode pair 42 and 44 forms a pair within a single plasma discharge channel. Any one of the sustaining electrode pair 42 and 44 is used as a scanning/sustaining electrode that responds to a scanning pulse applied in an address interval to cause an opposite discharge along with an address electrode (not shown) while responding to a sustaining pulse applied in a sustaining interval to cause a surface discharge with the adjacent sustaining electrode 42 or 44. Also, the remaining one of the sustaining electrode pair 42 and 44 is used as a common sustaining electrode to which a sustaining pulse is applied commonly. The trigger electrode pair 50 and 52 have wings 50A and 52A formed symmetrically at the outside of the center portion B. The trigger electrode pair 50 and 52 are provided between the sustaining electrode pair 42 and 44 to cause a trigger discharge by a wall voltage produced by the address discharge and an application voltage, thereby initiating a sustaining discharge. The trigger electrode pair 46 and 48 receives an AC trigger pulse voltage in the sustaining interval to cause an auxiliary discharge. Just after the auxiliary discharge is generated, a sustaining pulse is applied to the sustaining electrode 42. Then, the sustaining electrode pair 42 and 44 can generate a discharge by a priming effect caused by the auxiliary discharge, wall charges accumulated in the discharge cell and a voltage difference caused by the sustaining pulse. Such a sustaining discharge is continuously generated by the sustaining pulse and the trigger pulse.

Accordingly, in the PDP according to the second embodiment, the wings are formed at the center portions of the trigger electrodes such that the center portions of the trigger electrodes have a wide electrode area. Thus, since the wall charges are concentrated in the area around the wings of the trigger electrodes when the auxiliary discharge has been generated within the discharge cell, a voltage applied to the discharge cell becomes high even though a low voltage is applied to the trigger electrodes from the exterior. Therefore, the sustaining discharge can be maintained by an application of a low trigger voltage.

Figure 7:
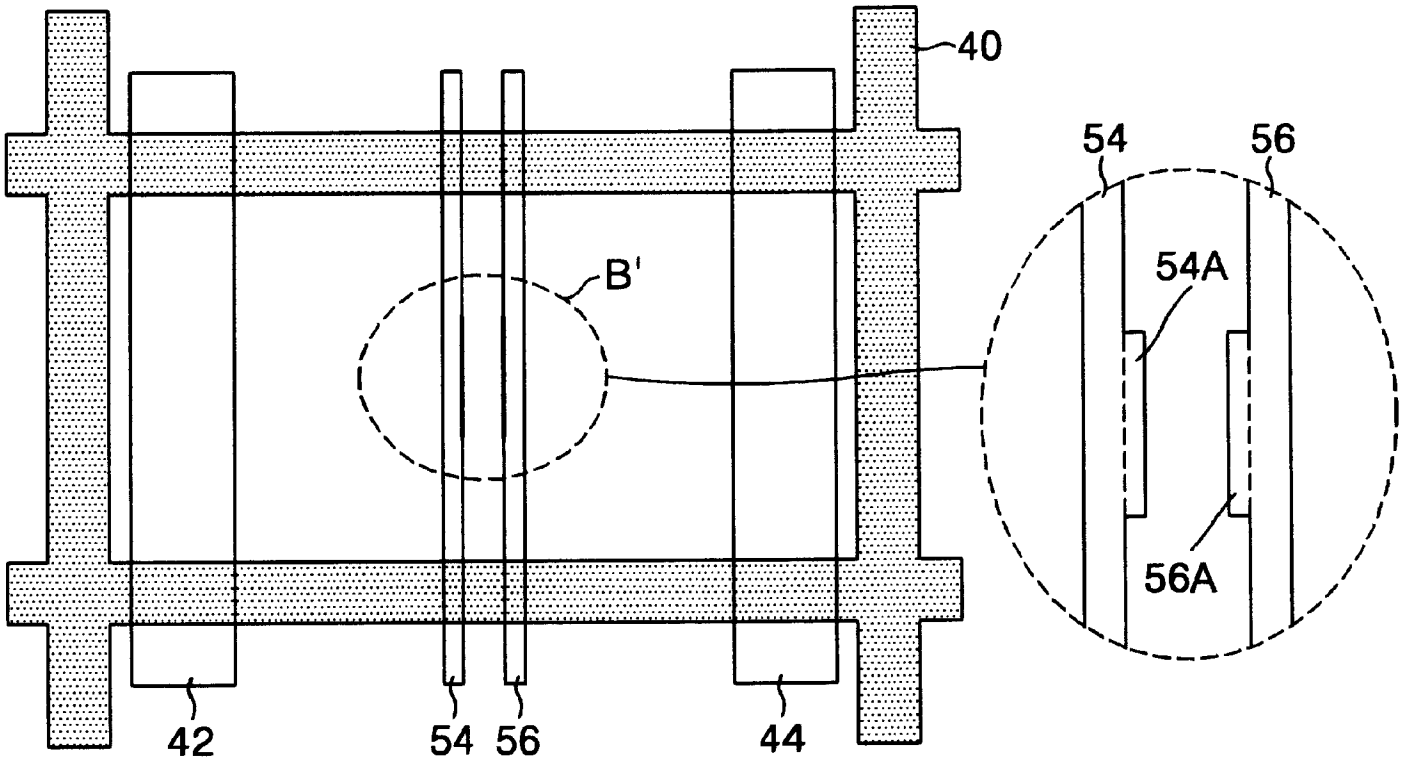
FIG. 7 is a plan view showing a discharge cell structure of a plasma display panel according to a third embodiment of the present invention.

Referring to FIG. 7, there is shown a five-electrode PDP according to a third embodiment of the present invention. The five-electrode PDP includes a sustaining electrode pair 42 and 44 and a trigger electrode pair 54 and 56 formed on a front substrate (not shown). The sustaining electrode pair 42 and 44 forms a pair within a single plasma discharge channel. Any one of the sustaining electrode pair 42 and 44 is used as a scanning/sustaining electrode that responds to a scanning pulse applied in an address interval to cause an opposite discharge along with an address electrode (not shown) while responding to a sustaining pulse applied in a sustaining interval to cause a surface discharge with the adjacent sustaining electrode 42 or 44. Also, the remaining one of the sustaining electrode pair 42 and 44 is used as a common sustaining electrode to which a sustaining pulse is applied commonly. The trigger electrode pair 54 and 56 has wings 54A and 56A formed oppositely at the inside of the center portion B'. The trigger electrode pair 54 and 56 are provided between the sustaining electrode pair 42 and 44 to cause a trigger discharge by a wall voltage produced by the address discharge and an application voltage, thereby initiating a sustaining discharge. The trigger electrode pair 46 and 48 receives an AC trigger pulse voltage in the sustaining interval to cause an auxiliary discharge. Just after the auxiliary discharge is generated, a sustaining pulse is applied to the sustaining electrode 42. Then, the sustaining electrode pair 42 and 44 can generate a discharge by a priming effect caused by the auxiliary discharge, wall charges accumulated in the discharge cell and a voltage difference caused by the sustaining pulse. Such a sustaining discharge is continuously generated by the sustaining pulse and the trigger pulse.

Accordingly, in the PDP according to the third embodiment, the wings are formed at the center portions of the trigger electrodes such that the center portions of the trigger electrodes have a wide electrode area. Thus, since the wall charges are concentrated in the area around the wings of the trigger electrodes when the auxiliary discharge has been generated within the discharge cell, a voltage applied to the discharge cell becomes high even though a low voltage is applied to the trigger electrodes from the exterior. Therefore, the sustaining discharge can be maintained by an application of a low trigger voltage.

Figure 8:
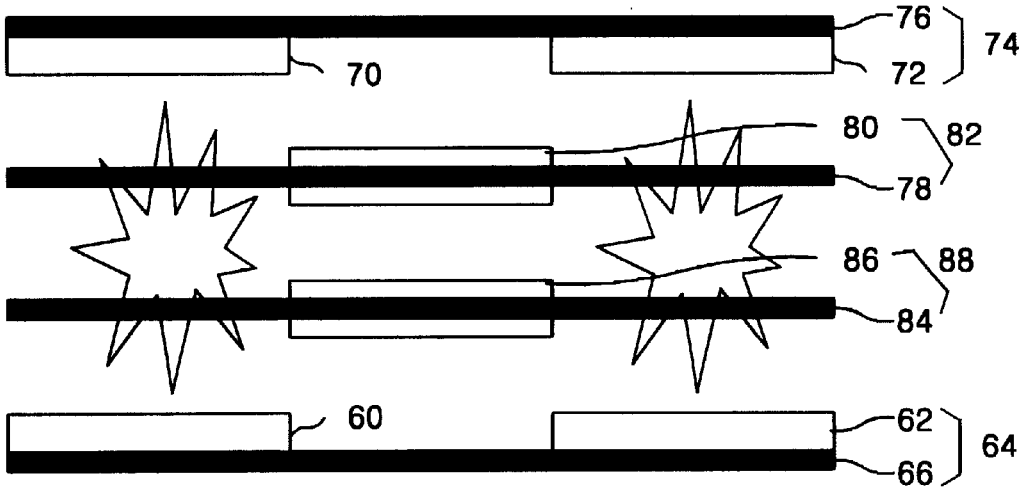
FIG. 8 is a plan view showing a discharge cell structure of a plasma display panel according to a fourth embodiment of the present invention.

Referring to FIG. 8, there is shown a five-electrode PDP according to a fourth embodiment of the present invention. The five-electrode PDP includes a sustaining electrode pair 64 and 74 formed, in parallel to each other, at each boundary portion of a discharge cell and having transparent electrodes 60, 62, 70 and 72 and metal bus electrodes 66 and 76, and a trigger electrode pair 82 and 88 formed, in parallel to each other, at a narrow distance between the sustaining electrode pair 64 and 74 and having transparent electrodes 80 and 86 and metal bus electrodes 78 and 84.

The sustaining electrode pair 65 and 74 forms a pair within a single plasma discharge channel. Any one of the sustaining electrode pair 64 and 74 is used as a scanning/sustaining electrode that responds to a scanning pulse applied in an address interval to cause an opposite discharge along with an address electrode (not shown) while responding to a sustaining pulse applied in a sustaining interval to cause a surface discharge with the adjacent sustaining electrode 64 or 74. Also, the remaining one of the sustaining electrode pair 64 and 74 is used as a common sustaining electrode to which a sustaining pulse is applied commonly. The transparent electrodes 60, 62, 70 and 72 formed on the metal bus electrodes 66 and 76 are separately patterned at each boundary portion of the discharge cell such that the sustaining discharge is generated at each edge of the discharge cell. Thus, a distance between the sustaining electrode pair 64 and 74 at the center portion of the discharge cell becomes different from that at the edge portion thereof. In other words, a distance between the sustaining electrode pair 64 and 74 is spaced with a wide distance at the center portion of the discharge cell while being spaced with a relatively narrow distance at each edge portion of the discharge cell. The transparent electrodes 80 and 86 of the trigger electrode pair 82 and 88 are arranged at each intersection between them and the address electrode to be formed only at the center portion of the discharge cell. Thus, since an area occupied by the transparent electrodes 80 and 86 of the trigger electrode pair 82 and 88 within the discharge cell is small, the trigger electrode pair 82 and 88 have a dielectric constant and a capacitance lower than the conventional trigger electrode pair. As a result, a leakage current caused by a high dielectric constant and a high capacitance of the trigger electrode pair 82 and 88 can be reduced, and a current value applied to the trigger electrode pair 82 and 88 can be reduced. Also, since the transparent electrodes 80 and 86 of the trigger electrode pair 82 and 88 are positioned only at the center portion of the discharge cell, the sustaining electrode pair 64 and 74 positioned at each edge of the discharge cell can effectively generate a sustaining discharge.

Accordingly, in the PDP according to the fourth embodiment, a reset pulse is applied to any one of the sustaining electrode pair 64 and 74 or the trigger electrode pair 82 and 88 arranged within all of the discharge cells so as to initialize all of the discharge cells of the panel, thereby causing a reset discharge. During the reset discharge, wall charges are produced for each discharge cell to lower a discharge voltage required for an address discharge. Then, a scanning pulse is applied to the sustaining electrode 74 and a data pulse is applied to the address electrode in synchronization with the scanning pulse, thereby generating an address discharge between two electrodes. Wall charges are formed at the dielectric layers of the upper and lower substrates by the address discharge. The wall charges formed in this manner lower a discharge voltage required for the sustaining discharge and the auxiliary discharge. In the discharge cells selected by the address discharge, the trigger electrode pair 82 and 88 provided between the sustaining electrode pair 64 and 74 are positioned at the center portion of the discharge cell to receive an AC trigger pulse voltage in the sustaining interval, thereby causing an auxiliary discharge. In such a discharge process, the wall charges are formed at the trigger electrode pair 82 and 88 and space charges are diffused into the entire space of the cell at which a discharge has been generated. The sustaining electrode pair 64 and 74 are arranged at a mutually wide distance at each outer side of the trigger electrode pair 82 and 88 to simultaneously receive a desired level of AC pulse voltage alternately with any one of the trigger electrode pair 82 and 88. The sustaining electrode pair 64 and 74 supplied with the AC pulse voltage simultaneously generates a plurality of sustaining discharge at each edge of the discharge cell by utilizing the space charges formed by the auxiliary discharge and the wall charges at the trigger electrode pair 82 and 88. Such a sustaining discharge is continuously generated by the sustaining pulse and the trigger pulse.

Accordingly, in the PDP according to the fourth embodiment, a plurality of sustaining discharge are simultaneously generated at each edge of the discharge cell with having the transparent electrodes of the trigger electrode pair therebetween. Thus, an energy produced upon sustaining-discharge is dispersed into each edge of the discharge cell to excite the fluorescent material, so that an excessive current emerging by an energy fed back to the electrodes can be minimized. As a result, the present PDP has advantages of a reduced power consumption and an enhanced discharge and light-emission efficiency.

As described above, according to the present invention, the wings are formed at the center portions of the trigger electrodes such that the center portions of the trigger electrode pair have a wide electrode area, and the transparent electrodes at the sustaining electrode pair are formed in such a manner to be spaced at the edge thereof. Thus, a plurality of sustaining discharge is simultaneously generated at each edge of the discharge cell with having the transparent electrodes of the trigger electrode pair therebetween. Thus, an energy produced upon sustaining-discharge is dispersed into each edge of the discharge cell to effectively excite the fluorescent material. Accordingly, the discharge and light-emission efficiency can be improved, and an excessive current emerging by an energy fed back to the electrodes can be minimized. As a result, the present PDP has a reduced power consumption and an improved brightness in comparison with the prior art.

Although the present invention has been explained by the embodiments shown in the drawings described above, it should be understood to the ordinary skilled person in the art that the invention is not limited to the embodiments, but rather that various changes or modifications thereof are possible without departing from the spirit of the invention. Accordingly, the scope of the invention shall be determined only by the appended claims and their equivalents.

What is claimed is:

1. A method of driving a plasma display panel including a sustaining electrode pair arranged at each edge of a discharge cell and an auxiliary electrode pair arranged between the sustaining electrode pair and not connected to the sustaining electrode pair within the discharge cell, said method comprising the steps of:

enlarging an area of the auxiliary electrode pair corresponding to a center portion of the discharge cell to concentrate wall charges on the center portion of the discharge cell during an auxiliary discharge generated between the auxiliary electrode pair; and causing a sustaining discharge between the sustaining electrode pair by utilizing the wall charges produced by the auxiliary discharge.

2. A plasma display panel, comprising:

a pair of auxiliary electrodes, wherein an area of the auxiliary electrodes at a center of a discharge cell is wider than that at a periphery of the discharge cell; and a pair of sustaining electrodes arranged at each side of the pair of auxiliary electrodes and not connected to the pair of auxiliary electrodes within the discharge cell.

3. The plasma display panel as claimed in claim 2, wherein the auxiliary electrodes comprise wings extending from at least one side of each of the auxiliary electrodes.

4. The plasma display panel as claimed in claim 3, wherein the wings are formed symmetrically on inner and outer sides of each of the auxiliary electrodes.

5. The plasma display panel as claimed in claim 3, wherein the wings are formed symmetrically on an outer side of each of the auxiliary electrodes.

6. The plasma display panel as claimed in claim 3, wherein the wings are formed symmetrically on an inner side of each of the auxiliary electrodes.

7. The plasma display panel as claimed in claim 3, wherein the wings have a constant width.

8. A plasma display panel, comprising:

a pair of auxiliary electrodes positioned at a center portion of a discharge cell; and a pair of sustaining electrodes arranged at each side of the pair of auxiliary electrodes and not connected to the pair of auxiliary electrodes within the discharge cell, and comprising metal bus electrodes and transparent electrodes extending parallel to one another along a length thereof, wherein the transparent electrodes of the sustaining electrodes are divided into at least two portions along a length thereof within the discharge cell.

9. The plasma display panel as claimed in claim 8, wherein an area of the auxiliary electrodes at a center of the discharge cell is wider than at a periphery of the discharge cell.

10. The plasma display panel as claimed in claim 9, wherein the auxiliary electrodes comprise wings extending from at least one side of each of the auxiliary electrodes.

11. The plasma display panel as claimed in claim 10, wherein the two portions are separated by a distance equivalent to a length of the wings.

12. The plasma display panel as claimed in claim 8, wherein the two portions of each of the transparent electrodes are each positioned at a respective edge of the discharge cell.

13. A method of driving a plasma display panel comprising a pair of sustaining electrodes positioned at each boundary portion between discharge cells and having transparent electrodes and metal electrodes, and a pair of auxiliary electrodes positioned between the pair of sustaining electrodes and having transparent electrodes and metal bus electrodes, said method comprising:

causing an auxiliary discharge between the pair of auxiliary electrodes; and simultaneously causing a plurality of sustaining discharges within the discharge cell using the pair of auxiliary electrodes.

14. The method as claimed in claim 13, wherein the plurality of sustaining discharges are simultaneously generated at each edge of the discharge cell.

15. The method as claimed in claim 14, wherein the transparent electrodes of the sustaining electrodes are divided into at least two portions along a length thereof within the discharge cell.

16. A plasma display panel, comprising:

a pair of auxiliary electrodes positioned at a center portion of a discharge cell; and a pair of sustaining electrodes arranged at each side of the pair of auxiliary electrodes and comprising metal bus electrodes and transparent electrodes extending parallel to one another along a length thereof, wherein the transparent electrodes of the sustaining electrodes are divided into at least two portions along a length thereof within the discharge cell, wherein the auxiliary electrodes comprise wings extending from at least one side of each of the auxiliary electrodes and wherein the two portions are separated by a distance equivalent to a length of the wings.

* * * * *